United States Patent [19]

La Fever

[11] 4,412,644

[45] Nov. 1, 1983

[54] SPILL RESISTANT DISPOSABLE PAPER DRINKING CUP

[76] Inventor: William C. La Fever, Box 2958 Star Rt. 31, Las Vegas, Nev. 89101

[21] Appl. No.: 284,779

[22] Filed: Jul. 20, 1981

[51] Int. Cl.[3] ..... B65D 3/26

[52] U.S. Cl. ..... 229/1.5 B; 229/4.5; 220/90.4; 220/270; 220/359

[58] Field of Search ..... 220/359, 90.2, 90.4, 220/270; 229/1.5 B, 21, 7 R, 4.5; 206/631, 633; D7/6

[56] References Cited

U.S. PATENT DOCUMENTS

| | | | |
|---|---|---|---|
| 2,088,832 | 5/1932 | Barbieri | 229/21 |
| 2,287,644 | 12/1939 | Schacht | 229/4.5 |
| 2,581,516 | 10/1947 | Cohen | 220/90.2 X |
| 2,765,639 | 4/1953 | Bryant | 220/90.4 |
| 3,966,081 | 6/1976 | Kawamata | 220/270 |

*Primary Examiner*—Steven M. Pollard
*Assistant Examiner*—David Voorhees
*Attorney, Agent, or Firm*—Richard L. Miller

[57] ABSTRACT

A disposable paper drinking cup that flares outwardly downwardly, so as to form a wide, non-tipping base for standing upon, and an opening upon its narrow upper end for dispensing a beverage therefrom, a reclosable tab on the upper end for the opening, and a pair of handles along a side of the cup for holding in a hand.

5 Claims, 5 Drawing Figures

SPILL RESISTANT DISPOSABLE PAPER DRINKING CUP

BACKGROUND OF THE INVENTION

It is well known that conventional paper drinking cups are made to flare upwardly outward from a narrow base so as to form a wide mouth at the upper end, for readily drinking therefrom, however this presents the problem of the cup being easily knocked over accidentally and spilling a beverage therefrom. This is objectionable so that this design is accordingly in need of an improvement.

SUMMARY OF THE INVENTION

Therefore it is a principal object of the present invention, to provide a disposable paper drinking cup which is designed to be upside down and have its outwardly flared end extending downward so as to form a more stable base preventing the cup from accidentally being tipped over.

Another object is to provide a spill resistant, disposable paper drinking cup which is frusto-conical in shape toward a wider lower base, so that it has a lower center of gravity for additional stability.

Yet another object is to provide a spill resistant, disposable paper, drinking cup which if desired can be used as a conventional drinking cup.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The figures on the drawings are briefly described as follows.

DETAILED DESCRIPTION OF THE PREFERRED EMBODIMENT

Figure 1:
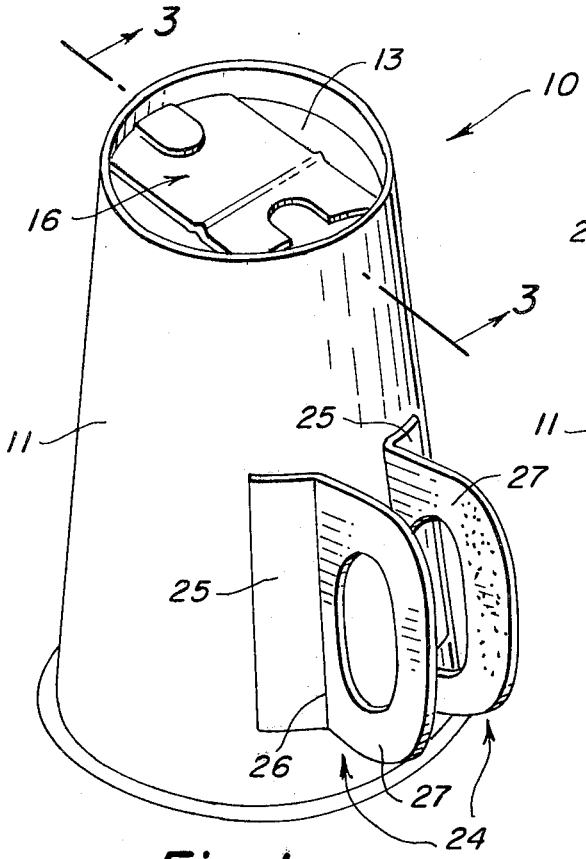
FIG. 1 is a perspective view of the invention shown with handles swung outward for use.
Figure 4:
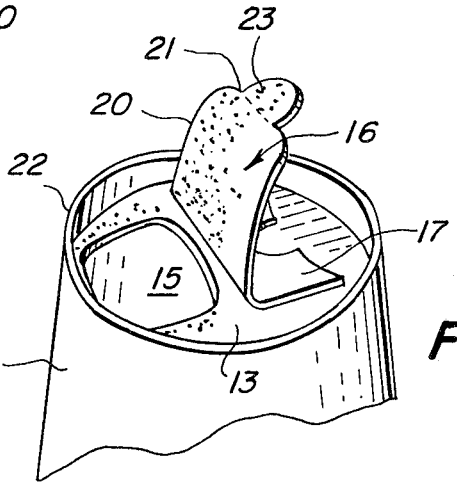
FIG. 4 is a view showing the pull tab lifted.

Refering now to the drawing in greater detail, the reference numeral 10 represents a spill resistant, disposable paper, drinking cup according to the present invention, wherein a paper side wall 11 is rolled around a small diameter paper end wall 13 so as to form a frusto-conical shaped container open at the larger end for introducing a beverage 14.

The upper end wall 13 includes a dispensing opening 15 die cut therein, and which is reclosable by a paper tab 16 permanently glued at one end 17 upon the end wall so as to pivot about an intermediate, transverse fold 18 in order to lift or lower an opposite end 19 of the tab over the opening 15. A wax 20 along an edge area of the tab serves to initially secure the tab to the cover in a leak proof manner while the shape of tab edge 21 fitting mechanical with inner edge rim 22, serve to frictionally hold the tab in a reclosed position. A tongue 23 on the top of the tab provides an easy means to lift the tab for access to the dispensing opening 15.

Figure 5:
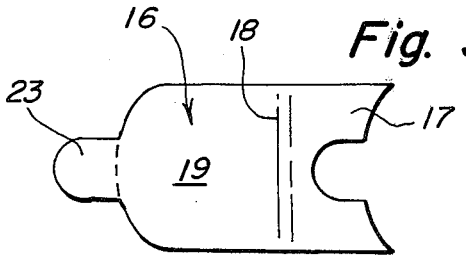
FIG. 5 is a plan view of the tab flat pattern.
Figure 2:
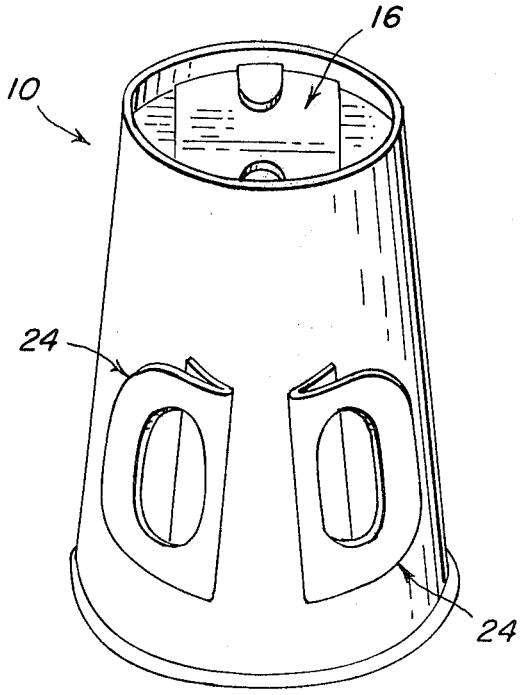
FIG. 2 is a perspective view thereof prior to swinging the handles outward.
Figure 3:
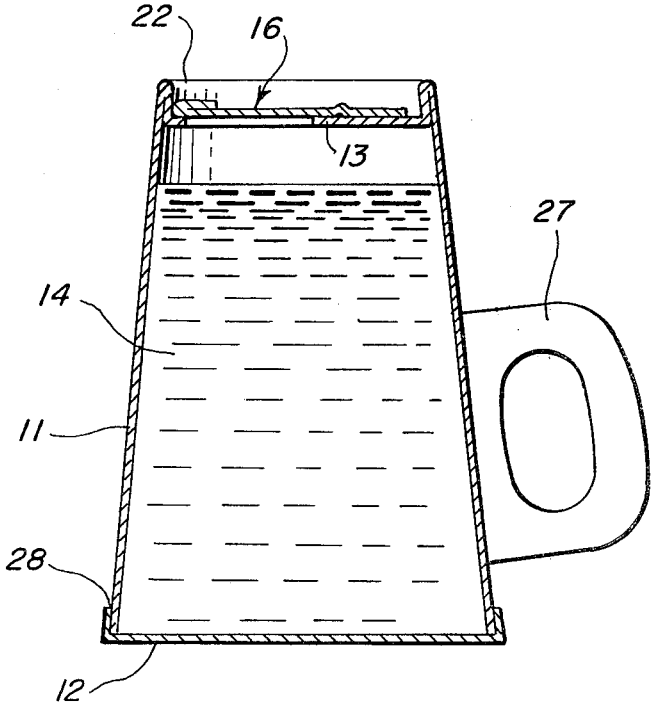
FIG. 3 is a cross sectional view on line 3—3 of FIG. 1.

FIG. 5 shows how the tab blank can be readily die cut from a strip of paper without any waste of material.

A pair of paper handles 24 are permanently adhered at one end 25 to the side wall 11 and bent about a transverse intermediate fold line 26 so as to form extending, spaced apart, parallel opposite ends 27.

It is to be noted that this design is suitable for paper drinking cups of all sizes. It may also be applied to a frusto-pyramidical as well as to a frusto-conical shaped cup.

In practical use the cup may be used as a conventional drinking cup in which case the cover 12 is never used and one drinks out of the larger end as with any ordinary paper cup.

However, if one desires to utilize the cup's spill resistant feature, then after filling the cup with beverage 14, the cover 12 is placed upon the large open end. A self sealing adhesive material 28 (similar to that used on envelopes that require no wetting to seal) is on the mating surfaces of the cover and the large open end of the cup so that once this cover is placed in place it cannot be removed and the beverage is sealed within this container.

While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

I claim:

1. A spill resistant, invertable, disposable paper drinking cup, comprising in combination, a side wall rolled around a small sized end wall at one end thereof, and a spaced apart larger sized open end at the other end thereof, an opening formed in said end wall, reusable tab means for covering said opening, sealing means for initially sealing said tab means over said opening in a leak proof manner, means for retaining said tab means in a closed condition over said opening after being unsealed, cover means for closing said open end, and additional sealing means for sealing said cover means to said open end in a leak proof manner, whereby said cup can be used with the open end upward prior to unsealing of the tab whereby said end walls forms the bottom of the cup, and said cup can also be used in an inverted manner by sealing of said cover means to the open end and unsealing said tab means to utilize said opening for access to the cup, whereby said cover means forms the bottom of the cup and the cup has an outward flare in a downward direction for greater stability.

2. The combination as set forth in claim 1, wherein a pair of handles on said side wall are selectively parallel apart or held together.

3. The combination as in claim 1 wherein said additional sealing means is operative upon placement of said cover means on said open end whereby once the cover means is placed on the open end it can not be removed.

4. The combination as in claim 1, wherein said side wall extends beyond said end wall to form an inwardly tapered skirt portion, and the peripheral edge of said tab means has a curvature corresponding to the shape of the side wall, whereby the tab means is retained in a closed position by the frictional engagement with said skirt portion.

5. The combination as set forth in claim 4, comprising a tongue member on said tab means for facilitation lifting of said tab means to expose said opening.

* * * * *